US006732782B2

(12) United States Patent
Rollion

(10) Patent No.: US 6,732,782 B2
(45) Date of Patent: May 11, 2004

(54) HAND-HELD DEVICE COMPRISING A MOVABLY MOUNTED APPLICATION MEMBER FOR TRANSFERRING A FILM FROM A BACKING STRIP ONTO A SUBSTRATE

(75) Inventor: Franck Rollion, Belloy en France (FR)

(73) Assignee: Societe Bic (FR)

( * ) Notice: Subject to any disclaimer, the term of this patent is extended or adjusted under 35 U.S.C. 154(b) by 0 days.

(21) Appl. No.: 10/226,252

(22) Filed: Aug. 23, 2002

(65) Prior Publication Data

US 2003/0041977 A1 Mar. 6, 2003

Related U.S. Application Data

(63) Continuation of application No. PCT/EP01/01583, filed on Feb. 13, 2001.

(30) Foreign Application Priority Data

Feb. 25, 2000 (EP) ..... 00103994

(51) Int. Cl.[7] ..... B32B 31/00

(52) U.S. Cl. ..... 156/577; 156/523; 156/579; 118/76; 118/257; 242/160.4; 242/171; 242/588.6; 206/411

(58) Field of Search ..... 156/523, 577, 156/579, 574, 527, 238, 540; 118/200, 257, 76; 225/46; 206/411; 242/170, 171, 588.3, 588.2, 588.6, 588, 160.4, 160.2

(56) References Cited

U.S. PATENT DOCUMENTS

| | | | | |
|---|---|---|---|---|
| 5,346,580 A | 9/1994 | Elges et al. | ..... | 156/540 |
| 5,772,840 A | 6/1998 | Morinaga | ..... | 156/540 |

FOREIGN PATENT DOCUMENTS

| | | | | |
|---|---|---|---|---|
| DE | 198 24 552 | 12/1999 | ..... | 35/7 |
| JP | 10-330021 | 12/1998 | ..... | 35/7 |

*Primary Examiner*—Richard Crispino
*Assistant Examiner*—Cheryl N. Hawkins

(57) ABSTRACT

The invention relates to a device for transferring a film of adhesive, covering, or colored material from a backing tape onto a substrate, having a housing in which a supply reel and a take-up reel for the backing tape are rotatably mounted, and comprising an application member arranged on the housing around which the backing tape loops. The application member is mounted so as to be moveable between a retracted non-use position and a pushed forward use position in which the application member is biased towards the non-use position by elastic pull-back force. The device has an actuation member which is disposed such that it is accessible from outside and, when moved with manual actuating force, enables the application member to move into its use position in which it is pressed against the substrate to transfer the film. With a view to facilitating and improving handling, the application member automatically moves into its non-use position of its own accord when the pressure of the device against the substrate or the actuating force is reduced to a respective certain value.

25 Claims, 3 Drawing Sheets

HAND-HELD DEVICE COMPRISING A MOVABLY MOUNTED APPLICATION MEMBER FOR TRANSFERRING A FILM FROM A BACKING STRIP ONTO A SUBSTRATE

CROSS-REFERENCE TO RELATED APPLICATIONS

The present application is a continuation of the U.S. National Stage designation of co-pending International Patent Application PCT/EP01/01583, filed on Feb. 13, 2001, which claims priority to European Patent Application 00 103 994.0, filed Feb. 25, 2000. The entire content of both these applications is expressly incorporated herein by reference thereto.

FIELD OF THE INVENTION

The invention relates to a device comprising a movably mounted member for transferring a film from a backing tape onto a substrate.

BACKGROUND OF THE INVENTION

A hand-held device for applying a film from a backing strip onto a substrate is described in EP 0 575 790 B1 (corresponding to U.S. Pat. No. 5,346,580 to Eldges et al.). In this known device a supply reel and a take-up reel for a backing tape and a spatula-shaped application member are mounted on a cassette which can be pushed into a housing through an opening from the rear. A use position and a non-use position for the cassette unit are provided. In the use position, the application member projects out of the housing so that it can be pressed against a substrate to transfer a film onto the substrate. In the non-use position, the application member is arranged in a recessed position in the housing. In this position, both the application member and the backing tape plus film running around the application member are protected against damage caused by other equipment which is almost impossible to prevent during handling at a workplace. In this known device, the cassette unit is secured in the use position of the application member against displacement in either displacement direction. In the non-use position, the cassette unit is prevented from being displaced backwards. This arresting movement is performed by a spring arm arranged on the cassette unit which comprises a push button with two push button stages arranged offset from each other in the longitudinal direction. The first push button stage projects through a through-hole in the housing in the use position and the second push button stage projects through the through-hole in the housing in the non-use position. The push button stages can be accessed from the outside by a finger of the user's hand through the through-hole. To displace the application member from its use position into its non-use position, the first push button stage has to be pressed inwards out of its latched position in the through-hole with manual pressure from outside, causing the cassette unit to be moved automatically into its non-use position by a pull-back spring where the second push button stage automatically locks it into place as a result of the spring force of the spring arm. The application member is moved from its non-use position into its use position by means of manual pressure on the rear end of the cassette unit which projects rearwards out of the housing and is therefore manually accessible. In the case of such a displacement into the use position, the first push button stage automatically engages in the through hole.

This known device is detrimental for several reasons. First, the device requires manual activation of a push-button to initiate displacement of the application member into its non-use position. It is easy for impact damage to be caused to the film in the projecting portion of the application member during handling in the workplace, it becomes clear that the application member has to be manually displaced into its non-use position relatively often, constituting considerable handling effort and demanding the person using the device pay close attention.

Another disadvantage of this known design lies in the fact that the application member extends axially relative to the longitudinal middle axis of the elongated or pen-shaped housing and can also be moved axially. This makes for an inopportune position of the device during handling.

A further drawback of the known device is that the known construction is only suitable for a device which has the reels and the application member arranged on an insert cassette. This known construction cannot be used in a device which has the application member and the reels mounted directly on the housing.

The fact that axial transverse force has to be exerted at the rear end of the device to move the application member into its use position is also to be regarded as a drawback of this known device. To do so, the device has to be gripped in a particular manner by both operating hands and subjected to a transverse force.

SUMMARY OF THE INVENTION

The present invention facilitates and improves the handling of a device for applying a film from a backing to a substrate (alternately referenced herein as an applicator device for the sake of convenience without any intent to limit) in its operating mode. This functioning should be at least partially automated or mechanized and it should be possible to perform or initiate the respective functions with user-friendly handling and operations. Furthermore, the device should be formed such that it is also possible to shift the application member between a retracted or submerged non-use position and a protruding use position even if there is no insertion cassette available, that is when the application member and the reels are mounted on the housing.

Backwards movement of the application member from its use position into its non-use position is effected automatically when the application member is removed from the substrate, or when the force with which the application member is pressed against the substrate or with which the actuation member is moved falls below a certain value, e.g., is no longer maintained, or when the manual operation of an actuation member for moving the application member into its use position is ended. The invention is based on the realization that the force with which the application member is pressed against the substrate during transfer of a film or the actuating force can be exploited to keep the application member in its use position, and to activate a preferably available positioning device for the application member which loses its function when the above-described features of the invention are realized. During handling of the device, the housing is to be held in a certain working position relative to the substrate and the actuation member is to be moved which, when manually grasping the device, can however occur at the same time and can therefore happen in a user-friendly manner with just one operating hand.

It is advantageous to provide the application member with a stopping face in the use position which restricts the movement of the application member into the non-use position during pressing onto the substrate or during the exertion of actuating force. This makes handling even simpler and relieves the user's hand to actuate the actuation member because the stopping surface introduces the majority of the pressing force into the housing without the user's hand having to counteract the thrust resulting from the pressing force by actuating or moving the actuation member.

It is also advantageous to bear the application member such that it is movable or swivellable transversely to its main direction of movement stretching between the use position and the non-use position. As described above, the pressing force can be used to move the application member transversely into a positioning position, e.g., against the stopping surface in which position it is positioned relative to a backwards movement. When the pressing-exerting force and/or actuating force is reduced or stopped, or the device is lifted from the substrate, the backwards movement of the application member and its movement into the non-use position can then also be effected automatically. In doing so, it is advantageous to generate each of these movements with elastic force or a common elastic force which is well suited for the automatic or self-acting backwards movement of the application member into its non-use position. The stopping surface can be formed by a guiding surface pointing laterally towards the front end of the application member and the application member can comprise a shoulder surface pointing away from its front end with which it is moveable, in particular swivellable, in the backing tape deflecting plane into a position interacting with the guiding surface. In this design, the application member can, in its use position, be subjected to a transverse movement to bring it into a stopping position with the guiding surface, which forms a stop against pull-back movement of the application member. This makes handling considerably simpler because the operating hand can transfer the pressure onto the application member indirectly over the housing rather than directly.

The handling of the applicator device of the present invention is also simplified for ergonomic reasons. This is conditioned by the fact that the application member is positioned favorably relative to the substrate in a normal workplace when the device is held comfortably in the operating hand. In this position, the necessary pressure required for transferring the film can be applied in a user-friendly manner. A further advantage of this embodiment is that an actuation member for moving the application member into its use position can be arranged in a simple and ergonomically favorable way in the front portion of the top side of the device. In such an arrangement, the pushing out movement of the application member and the actuation member can be exploited to exert the pressure directly, the actuation member being used as an abutment on which, for example, a finger of the operating hand can apply the pressing force in a user-friendly manner.

The invention is also based on the object of improving the backing tape guidance or the deflection around the application member in an applicator device, especially during shifting of the application member between its non-use position and its use position.

The backing tape is guided closely about the front end of the application member with contact thereto in both positions of the application member. In this embodiment, guidance of the backing tape in the moving section of the application member is guaranteed, thus preventing defects being caused by loops forming.

In an arrangement guiding the movement of the application member on the housing, this embodiment can also be realized without providing a cassette unit for the application member and the reels. In this embodiment, it is beneficial for the backing tape to form a substantially closed loop in its course about the application member. This enables the loop to adapt to the positional changes of the application member when the movement of the application member changes. Furthermore, it is beneficial for the application member and its direction of movement to extend transversely to the middle axis of the loop. This has a favorable effect on the changes in the course of the backing tape during movements of the application member and difficulties regarding a loss of guidance for the backing tape, and start-up problems during transfer of the film from the backing tape to the substrate can be avoided.

The further embodiments contain features which lead to small and functioning designs which can be beneficially integrated in the device and also allow production at reasonable costs.

BRIEF DESCRIPTION OF THE DRAWINGS

The detailed description will be better understood in conjunction with the accompanying drawings, wherein like reference characters represent like elements, as follows.

Figure 1:
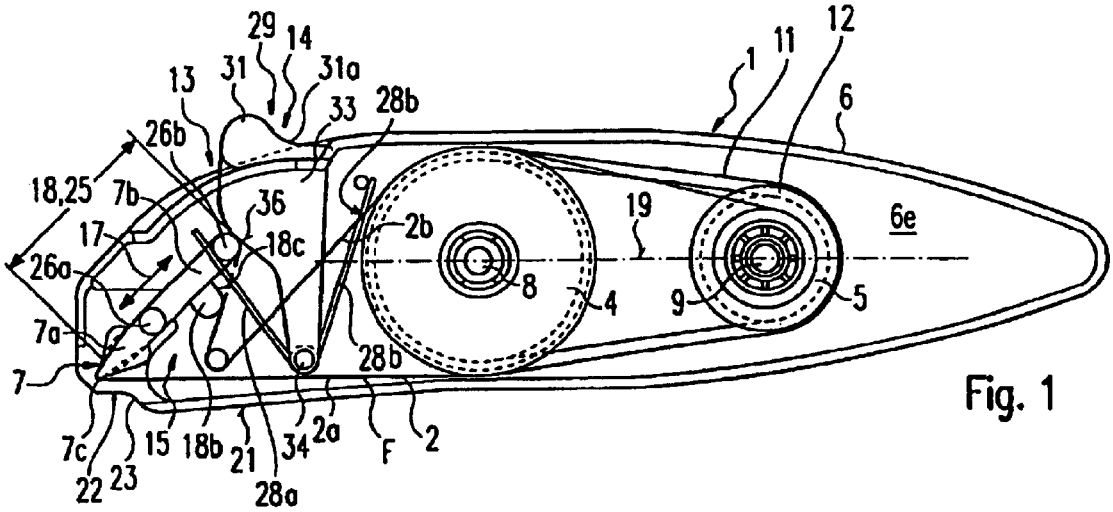
FIG. 1 is a side elevational view of a device formed in accordance with the principles of the present invention with an open housing.
Figure 4:
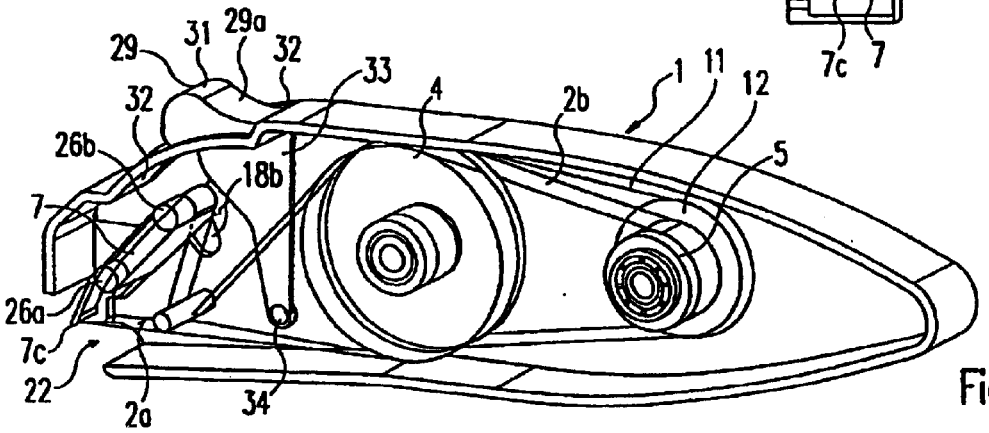
FIG. 4 is a side perspective view of the device of FIG. 1.

The device of the present invention, generally denoted as 1, as shown in FIG. 1, serves to transfer a film F located on a backing tape 2 onto a substrate S (see, e.g., FIG. 6), backing tape 2 being arranged on a supply reel 4 and a take-up reel 5 in a housing 6 of device 1. Housing 6 has an elongated or oblong shape with an essentially rectangular cross-section and is positioned upright in its yet to be described functioning position. A preferably spatula-shaped application member 7, about which backing tape 2 runs, projects from housing 6 and is disposed in the lower section of the front end of housing 6. By manually pressing application member 7 onto substrate S while simultaneously pushing device 1 in its backwards direction of movement 39 (FIG. 6), lower backing tape section 2*a* (FIG. 4) is peeled off supply reel 4 and is automatically wound up onto take-up reel 4 as upper backing tape section 2*b* (see FIG. 4). In the exemplary embodiment at hand, supply reel 4 and take-up reel 5 are rotatably mounted on two rotational axes 8, 9 which extend transversely to the deflection plane E (see FIG. 2) of backing tape 2 and have a gap therebetween in the longitudinal direction of housing 6, take-up reel 5 being arranged behind supply reel 4.

Figure 2:
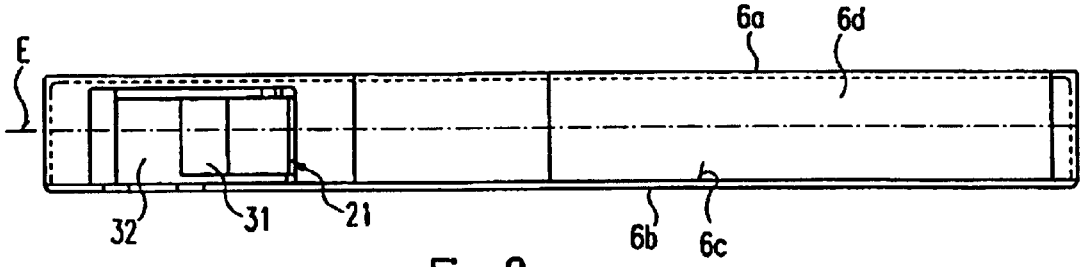
FIG. 2 is a top view of the device of FIG. 1.
Figure 3:
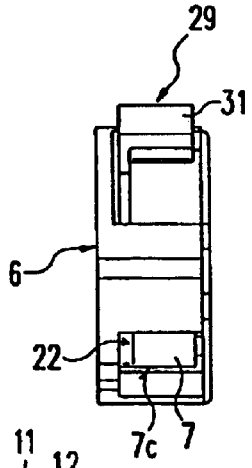
FIG. 3 is a front view of the device of FIG. 1.

As shown in FIG. 2, housing 6 consists of two housing parts 6*a*, 6*b*, the dividing joint 6*c* of which runs in or parallel to the deflection plane E of backing tape 2. Housing part 6*a* arranged at the top of FIG. 2 can be formed to be shell-shaped with a peripheral wall 6*d* and another housing part 6*b* can be formed to be essentially flat and to serve the purpose of a lid. Reels 4, 5 are rotatably mounted on pivot bearing parts (not illustrated in detail) which can project from the side walls of one of housing parts 6*a*, 6*b*.

Drive connection 11, having an integrated sliding clutch 12, is arranged between reels 4, 5. Drive connection 11 is formed such that it drives take-up reel 5 at such a speed (bearing in mind the respective effective winding diameters of full and empty reels 4, 5) that backing tape section 2*b* to be wound up is always slightly taut. Sliding clutch 12 prevents backing tape 2 from being overstretched and breaking. Above a certain drive torque effective in drive connection 11, sliding clutch 12 then jumps into action with the result that although drive connection 11 attempts to drive take-up reel 5 at a quicker speed, at the take-up surface, it is only driven at a speed which matches the speed at which backing tape 2 is moving.

To prevent reverse rotation of reels 4, 5, caused, for example, by tensions in backing tape 2, one of two reels 4, 5 is allocated with a return stop (not illustrated).

In the front end portion of housing 6, there is provided a displacing device 13 for displacing application member 7 between a non-use position located in a recessed or protected position in housing 6 (FIG. 1) and a use position (FIGS. 6–8) in which the front wedge-shaped end portion of application member 7 projects out of housing 6. The displacing device 13 comprises a push-out mechanism 14 for application member 7 which is moved manually and a push-in mechanism 15 for application member 7 which starts working on its own and pushes application member 7 back into its non-use position when the manual movement of push-out mechanism 14 is complete, or application member 7 is lifted from substrate S, or a pressing force pushing application member 7 against substrate S (see arrow 16 in FIG. 6) falls below a certain value or stops altogether. For this pushing movement, a guide 18 running longitudinally along direction of movement 17 is provided which, in the present embodiment, extends in a straight line. Application member 7 is elongated and has a guide shaft 7*b* extending from an application section 7*a* into an actual application element or tip 7*c* (application tip 7*c* is spatula-shaped in this embodiment and referenced herein as an application tip for the sake of convenience without any intent to limit) in the opposite direction. As shown in FIG. 8, guide axis 18*a* extends diagonally or crossways to longitudinal axis 19 of housing 6 and can enclose an obtuse angle, for example of about 135°, between guide axis 18*a* and longitudinal axis 19 which opens towards pressure-exerting side or bottom side 21 which faces the substrate S when device 1 is being used. As shown in FIG. 1, so that application member 7 can pass through, a channel opening 22 is located in peripheral wall 6*d*, preferably in the lower front corner section of housing 6. In the region of channel opening 22, housing 6 can have a recess 23 on its bottom side which forms a recess step of a few millimeters with the rest of bottom side 21 of housing 6.

Guide 18 can be formed by grooves 25 (See FIG. 1) formed on one or both sides in at least one side wall 6*e* of housing 6. Application member 7 engages in these grooves 25 with lateral guide elements, such as in the form of laterally projecting guide pegs 26*a*, 26*b*, at least front guide pegs 26*a* of which are formed to have a round or cylindrical cross-section parallel to deflection plane E. A transverse guide portion 18*b* extends transversely from the central portion of the guide 18 towards bottom side 21, guide surface 18*c* of which faces the free end of application member 7 and forms a stop for application member 7 which restricts the pushing back movement of application member 7 when it is in its use position. To gain guiding contact with guide surface 18*c*, application member 7 has to be pivoted in its use position. This is possible because front guide pegs 26*a* have a round cross-sectional shape and rear guide pegs 26*b* can swivel into the transverse guide portion 18*b*. A reverse movement spring 28 acts upon application member 7 and biases application member 7 into its non-use position, therefore displacing it into its non-use position when device 1 is not being used.

As shown in FIG. 1, push-out mechanism 14 has an actuation member 29 which is mounted so as to be essentially moveable backwards and forwards along guide 18 and projects through peripheral wall 6*d* in the upper front region through a passage opening 32 with an actuation member 31 and thus is accessible and can be operated manually from outside, especially with a finger, preferably the index finger, of the hand using the device. For this purpose, an actuation cam, which forms actuation element 31 projecting from housing 6, has a diagonal or concavely shaped pressure-exerting surface 31*a* on its rear side which points upwards and which the user's hand can securely act upon. In this exemplary embodiment, actuation member 29 is a pivoted lever which is rotatably mounted with one or two side bearing limbs 33 to one pivot bearing 34, respectively, which is preferably formed in the lower region of housing 6 and on the side wall 6*e* of housing 6 and can, for example, be formed by an inward-springing bearing peg. Actuation element 31 is formed by a transverse web arranged at the top end of bearing limb 33 which bridges over application member 7. Bearing limb 33 forms a pressure-exerting surface 36 on its front side which moves application member 7 into its use position when actuation member 29 is moved forward and in doing so is in sliding contact with application member 7, for example with at least one side or double-sided rear guide peg 26*b*. Pressure-exerting surface 36 is, for example, formed as a convex curved surface as in FIG. 1 such that it exerts a torque or force (see arrow 37 in FIG. 5) on application member 7 when application member 7 is in its use position. This torque attempts to swivel application member 7 clockwise as in FIG. 1. This is made possible by the particular, possibly curved, course of pressure-exerting surface 36 which, in the region of this intermediate position of application member 7 according to FIG. 5, encloses an obtuse angle W between pressure-exerting surface 36 and the lengthways direction of guide 18, this angle W opening towards pressure-exerting side 21 and of such a size that the swivel movement component is transferred to application member 7. The force of reverse movement spring 28 is overpowered by manual force 38 acting upon actuation member 29. When the movement of actuation member 29 is complete, reverse movement spring 28 first swivels application member 7 backwards and then pushes application member 7 back into its non-use position.

When the top end portion of application member 7 is forced into transverse guide section 18*b* during forwards movement of actuation member 29, application member 7 is swivelled about its guide peg 26*a* (FIG. 6) with application member 7 abutting guide surface 18*c* under the effect of reverse movement spring 28.

Figure 5:
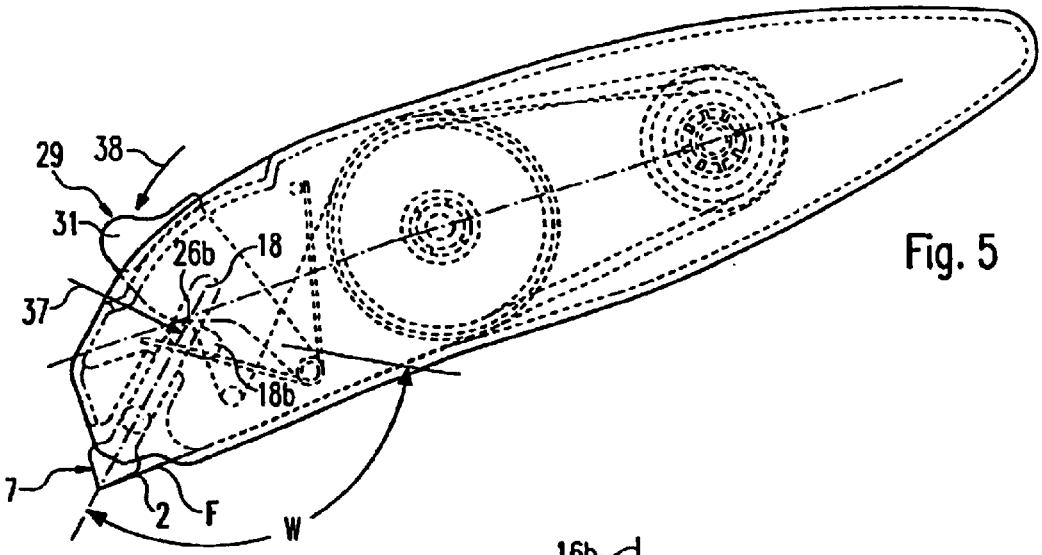
FIGS. 5 to 7 are side elevational views of the device in various functioning positions.
Figure 6:
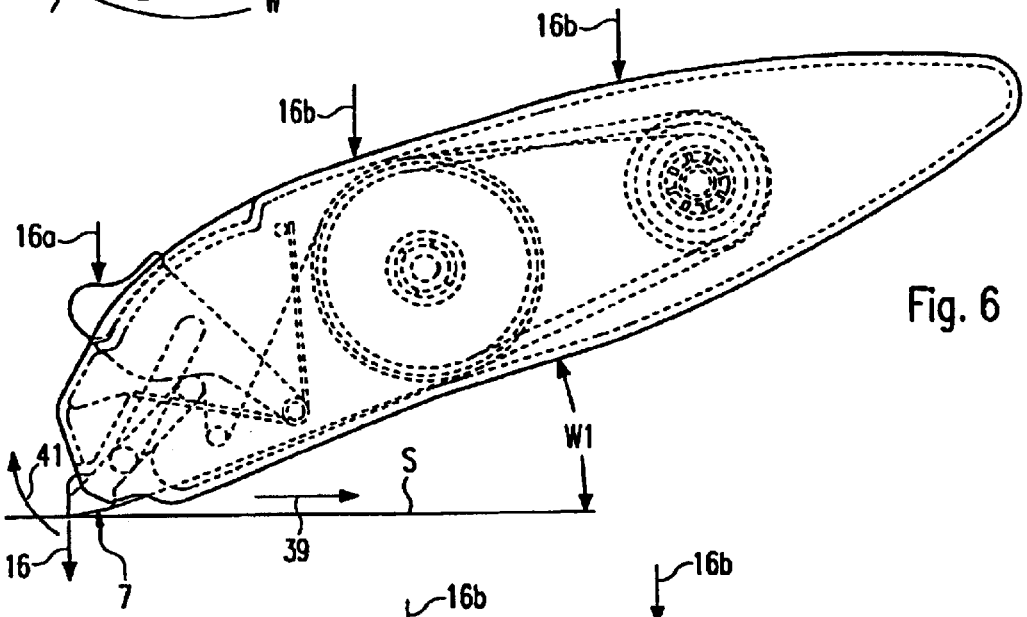

The use position of the application member according to FIGS. 5 and 6 as described thus far can be achieved just by moving actuation member 29, wherein device 1, gripped by the operating hand, is in free space.

Figure 7:
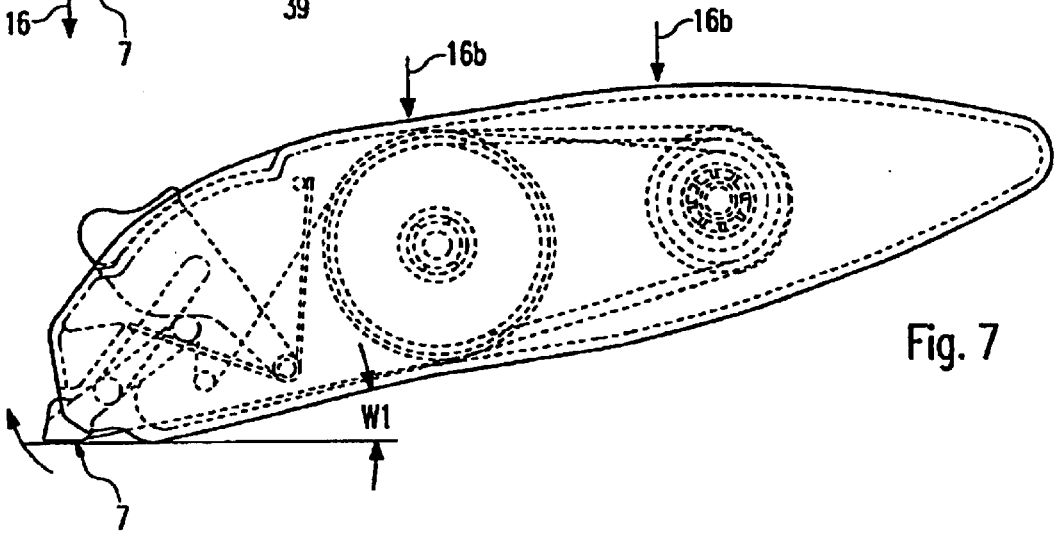
Figure 8:
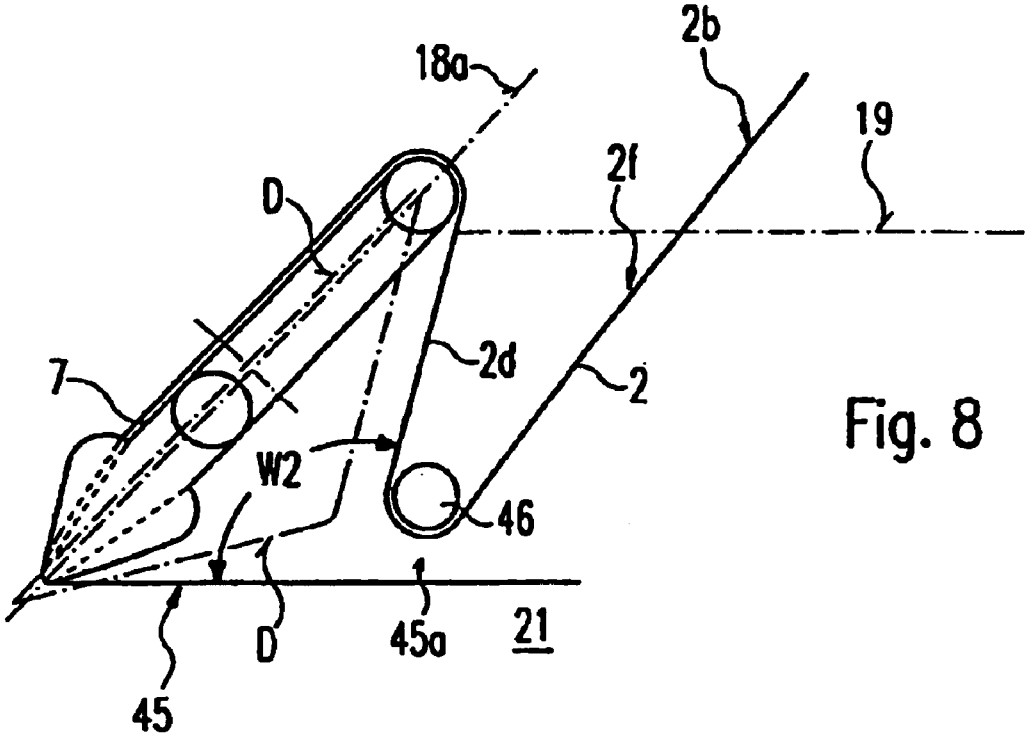
FIG. 8 is an isolated side elevational view of an application member according to the principles of the present invention.

In this forwardly displaced position of actuation member 29 and application member 7, in which, for example, a finger of the operating hand presses against actuation element 31 in the direction of arrow 38, application member 7 is pushed against substrate S, for instance, in the position shown in FIG. 6 or 7. The pressure-exerting force 16 is generated by exerting pressure on actuation member 29 and, where appropriate, on the housing as well, as indicated by force arrows 16*a*, 16*b*. For the purpose of transferring film F onto substrate S, application member 7 is moved backwards in the direction of arrow 39. As a result of this pressing on substrate S and/or this movement, a torque as indicated by arrow 41, is produced at application member 7, particularly as a consequence of the inclined arrangement of application member 7. This torque supports or completely takes over the pivoting movement of the rear end portion of application member 7 into transverse guide section 18*b*. This torque 41 is intensified even more when device 1 is pivoted further towards substrate S, (see FIG. 7) in which device 1 and substrate S enclose an angle W1 of approximately 10°, in contrast to FIG. 6 where this angle W1 can be approximately 20°. As a result of the effectiveness of torque 41, the actuation of actuation member 29 can be left out or this operation can be ended and actuation member 29 released, application member 7 then remaining in its stopping position on the guide surface 18*c* and application member 7 being possible to maintain pressure-exerting force 16 by pressure on housing 6 as indicated by force arrows 16*b* in FIG. 7. In this position, too, it is possible for the film F to be transferred by moving device 1 in the direction of arrow 39.

Within the scope of the present invention, it is also possible to form push-in mechanism 15 and push-out mechanism 14 such that pressure 16*a* also has to be exerted on actuation member 29 in the position illustrated in FIG. 6 or 7. In this case, necessary pressure 16*a* is however reduced by torque 41, thus making handling easier.

If pressure-exerting force 16, or actuation force 16*a*, or manual force 38 acting upon actuation member 29, is less than a certain value, application member 7 automatically moves into its non-use position as a result of the spring resistance, wherein application member 7 is first rotated or swivelled from its stopping position and is then moved laterally into its non-use position.

Within the scope of the present invention, it is possible to provide two reverse movement springs, one for rotational movement and one for lateral movement of application member 7. However, it is preferable for a common reverse movement spring 28 to be provided for both movements which produces a resulting reverse movement force such that both reverse movements can be performed by this reverse movement force. In this exemplary embodiment, a bending bar spring 28*a* is provided which extends transversely to the longitudinal direction of guide 18 and extends beyond a forwards-pointing shoulder surface on application member 7, e.g., a rear guide peg 26*b*, and acts upon application member 7 in the direction towards its non-use position. Bending bar spring 28*a* can be borne on pivot bearing 34 by a helix and a second spring limb 28*b* can also be provided which undercuts a stop on housing 6.

Figure 9:
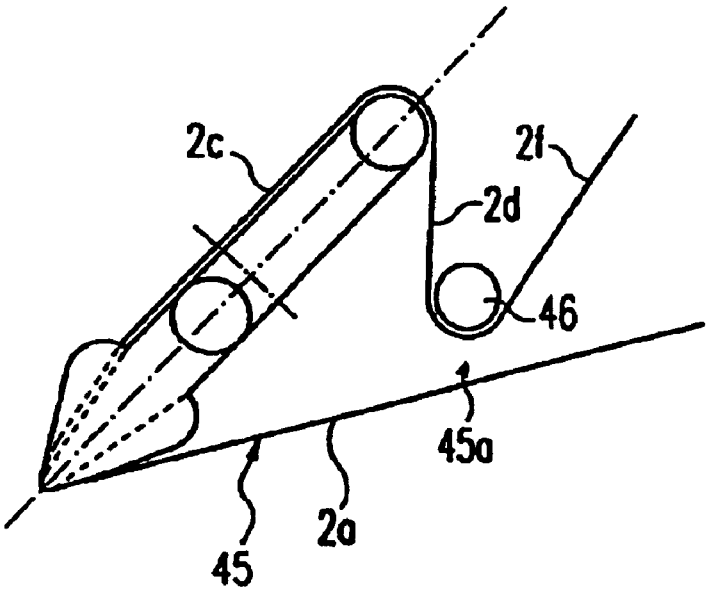
FIG. 9 is an isolated side elevational view of the application member according to FIG. 8 in a different functioning position.

A special feature of the deflection (denoted by reference number 45) of backing tape 2 about application member 7 will now be described with the aid of FIGS. 8 and 9. FIG. 8 shows application member 7 with deflection 45 in the non-use position according to FIG. 1. FIG. 9 shows application member 7 with associated deflection 45 in the use position as per FIG. 6 or 7.

As shown in FIGS. 8 and 9, apart from a small opening 45*a* of, for example, approximately 1 to 5 mm, loop 45 takes on the shape of a closed triangle, one side of the triangle being determined by the forwards facing long side of application member 7 at which a backing tape section 2*c* runs over the entire length of application member 7 and is deflected to backing tape section 2*a* at the front bottom somewhat rounded end of application member 7 and, at the top rear rounded end of application member 7 is deflected to backing tape section 2*d* which extends transversely to longitudinal middle axis 19 to fixed deflection roller 46, which is preferably located near pressure-exerting side 21 of housing 6 and, as a continuing backing tape section 2*e*, forms a loop 2*f* of backing tape section 2*b* traveling from supply reel 4 to take-up reel 5 which extends towards pressure-exerting side 21. On the side of fixed deflection roller 46 facing pressure-exerting side 21, the triangular shape is open thanks to a gap between backing tape section 2*a* and fixed deflection roller 46 (see opening 45*a*). Backing tape sections 2*a*, 2*c*, and 2*d* form a loop 45 which has the shape of an essentially isosceles triangle D, backing tape sections 2*a*, 2*d* forming the equal sides of isosceles triangle D and backing tape section 2*c* or front long side of application member 7, forming the opposing side of isosceles triangle D of an unchangeable length, this length matching the length of application member 7. Isosceles triangle D is particularly present in the middle position of application member 7 (not illustrated) and is indicated in FIG. 8 with a dashed line. It has to be taken into account in this respect that isosceles triangle D shape is slightly deformed in the non-use position (FIG. 8) and in the use position (FIG. 9) because of the lateral and transverse movement of application member 7. As the lateral movement only surmounts to approximately 5 mm to 7 mm, and the transverse or swivel movement only amounts to approximately 3 mm, the distortion in shape in the positions after completed movement is small. Because there are deflections 45 at both ends of application member 7, preferably in the shape of an isosceles triangle, the lengths of the approaching and returning backing tape sections 2*a*, 2*d* are balanced automatically during movement of application member 7 by means of the tape sliding. This prevents a loop lifting off application member 7 being formed in backing tape 2. This prevents operating problems and especially starting problems when placing application member 7 on substrate S.

Approaching and returning backing tape sections 2*a*, 2*d* can enclose an acute or an obtuse angle W2 between them, this angle being open towards application member 7. When angle W2 is obtuse, there is a small construction which is advantageous under consideration of the restricted room available in housing 6.

What is claimed is:

1. A device for transferring a film from a backing tape onto a substrate, said device comprising:

a housing;

a supply reel rotatably mounted on said housing;

a take-up reel rotatably mounted on said housing;

an application member movably disposed on said housing for movement between a non-use position and a use position in which said application member is biased towards said non-use position by an elastic pull-back force; and a displacing device with an actuation member accessible from outside said device;

wherein:

when said actuation member is actuated with manual actuating force, said application member moves into said use position;

said application member automatically moves into said non-use position when at least one of the following conditions is met: the manual actuating force is complete, or said application member is lifted from the substrate, or a pressing force pushing said application member against the substrate is reduced below a certain value, or stops altogether;

said application member is a component separate from said actuation member and is movably mounted in said housing in a guide of its own.

2. A device according to claim 1, wherein:

said housing has a front end portion; and said displacing device is disposed in said front end portion of said housing.

3. A device according to claim 1, wherein:

said housing has an upper section and a lower section and said actuation member is provided as a pivoted lever accessible from above said upper section of said housing and is mounted with at least one side bearing limb in a pivot bearing mounted in said lower section of said housing.

4. A device according to claim 1, wherein:

said housing has an application end; and said actuation member is pivotably mounted for moving said application member, in said use position, towards said application end of said housing.

5. A device according to claim 1, wherein said application member in said use position is prevented from moving into said non-use position by a stopping surface.

6. A device according to claim 1, wherein said application member:

has a front portion;

has a side guide peg arranged on said front portion in a deflection plane of the backing tape;

is pivotably mounted around said side guide peg; and is swivellable in front of a stopping surface.

7. A device according to claim 6, wherein:

said application member has a rear portion;

said application member has a rear side guide peg arranged on said rear portion of said application member;

a guide is formed in said housing adjacent said application member;

a transverse guide portion extends from said guide towards a side of said device facing the substrate; and said application member is swivellable about said rear side guide peg.

8. A device according to claim 1, wherein:

said application member has a rear portion;

said application member has a rear side guide peg arranged on said rear portion of said application member;

a guide is formed in said housing adjacent said application member;

a transverse guide portion extends from said guide towards a side of said device facing the substrate; and said application member is swivellable about said rear side guide peg.

9. A device according to claim 1, wherein:

said housing has an upper section; and said actuation member is accessible from above said upper section of said housing.

10. A device according to claim 7, wherein:

a transverse guide portion extends to a side of said device facing the substrate;

said application member has a rear portion on which rear side guide peg extends; and said application member is swivellable about said rear side guide peg.

11. A device according to claim 1, wherein said actuation member is a pivoted lever pivotably mounted with at least one bearing limb in a pivot bearing.

12. A device according to claim 1, wherein said actuation member is a pivoted lever pivotably mounted with two opposing side bearing limbs in a pivot bearing.

13. A device according to claim 1, wherein said housing is oblong in shape.

14. A device according to claim 1, wherein said application member has at least one lateral guide element movably guiding said application member in a guide formed in said housing.

15. A device according to claim 1, wherein:

said housing has a longitudinal middle axis; and said application member moves between said non-use position and said use position in a direction of movement transverse to said longitudinal middle axis of said housing.

16. A device according to claim 15, wherein said longitudinal middle axis and said direction of movement enclose an obtuse angle open towards a free end of said application member.

17. A device according to claim 1, wherein:

a guide is formed in said housing; and said application member has at least one guide element movably guided in said guide.

18. A device according to claim 1, wherein a common spring is provided for moving said application member into said non-use position.

19. A device according to claim 1, wherein:

said housing has a top side; and said actuation member extends through an opening in said top side of said housing.

20. A device for transferring a film from a backing tape onto a substrate, said device comprising:

a housing;

a supply reel rotatably mounted on said housing;

a take-up reel rotatably mounted on said housing;

an application member with an application end and an opposite end; and a displacing device with an actuation member accessible from outside said device;

wherein:

said application member is movably disposed on said housing for movement between a non-use position and a use position in which said application member is biased towards said non-use position by an elastic pull-back force;

when said actuation member is actuated with manual actuating force, said application member moves into said use position; and said application member movement is relative to said supply reel and said take-up reel; and the backing tape loons around said application end with a first backing tape section and a second backing tape section extending from said supply reel and loops around said opposite end of said application member with the second backing tape section and a third backing tape section.

21. A device according to claim 20, wherein the backing tape loops around said application member on all sides in a triangular shape with an opening.

22. A device according to claim 20, wherein the backing tape loop loops around in an isosceles triangular shape when said application member is in a middle position between said use position and said non-use position.

23. A device according to claim 20, wherein:

said actuation member has a pressure surface at its front side, and said pressure surface moves said application member forward into said use position in the event of a forward movement of said actuation member.

24. A device for transferring a film from a backing tape onto a substrate, said device comprising:

a housing;

a supply reel rotatably mounted on said housing;

a take-up reel rotatably mounted on said housing;

an application member movably disposed on said housing for movement between a non-use position and a use position in which said application member is biased towards said non-use position by an elastic pull-back force; and a displacing device with an actuation member accessible from outside said device;

wherein:

when said actuation member is actuated with manual actuating force, said application member moves into said use position;

said application member automatically moves into said non-use position when at least one of the following conditions is met: the manual actuating force is complete, or said application member is lifted from the substrate, or a pressing force pushing said application member against the substrate is reduced below a certain value, or stops altogether; and in its use position, said application member is prevented from moving into its non-use position by a stopping surface, and is capable of remaining in said use position without pressure being exerted on said actuation member.

25. A device according to claim 24, wherein said application member in its use position is pivotally mounted in the deflection plane of the backing tape and is capable of swiveling in front of said stopping surface.

* * * * *